US009051076B2

(12) United States Patent
Ahsan

(10) Patent No.: US 9,051,076 B2
(45) Date of Patent: Jun. 9, 2015

(54) CONTAINER HAVING A PLURALITY OF IDENTIFIED MARKINGS TO REDUCE CONTAINER VOLUME DURING USE

(76) Inventor: Leena Ahsan, Hopewell Junction, NY (US)

( * ) Notice: Subject to any disclaimer, the term of this patent is extended or adjusted under 35 U.S.C. 154(b) by 196 days.

(21) Appl. No.: 13/585,713

(22) Filed: Aug. 14, 2012

(65) Prior Publication Data

US 2014/0048588 A1 Feb. 20, 2014

(51) Int. Cl.
*B65D 5/54* (2006.01)
*B65D 5/355* (2006.01)

(52) U.S. Cl.
CPC ..... *B65D 5/5475* (2013.01); *B65D 5/0005* (2013.01); *B65D 5/5445* (2013.01)

(58) Field of Classification Search
CPC ..... B65D 5/0005; B65D 5/5475
USPC ..... 229/101.1, 101.2, 235, 101, 237, 931
See application file for complete search history.

(56) References Cited

U.S. PATENT DOCUMENTS

| | | | | |
|---|---|---|---|---|
| 2,056,032 | A | 9/1936 | Berman | |
| 3,128,031 | A | 4/1964 | Dembo | |
| 3,167,240 | A * | 1/1965 | Collura et al. | 229/101.2 |
| 3,168,234 | A | 2/1965 | Bartz | |
| 3,291,372 | A | 12/1966 | Saidel | |
| 3,302,855 | A | 2/1967 | Becker | |
| 3,971,506 | A | 7/1976 | Roenna | |
| 4,512,478 | A | 4/1985 | Korte | |
| 4,648,513 | A | 3/1987 | Newman | |
| 5,251,808 | A | 10/1993 | Rudd | |
| 6,336,584 | B1 * | 1/2002 | Roch et al. | 229/101.2 |
| 6,676,009 | B1 | 1/2004 | Rose | |
| 7,988,034 | B2 | 8/2011 | Pezzoli | |
| 2006/0255107 | A1 * | 11/2006 | Wright | 229/101.2 |

* cited by examiner

*Primary Examiner* — Christopher Demeree
(74) *Attorney, Agent, or Firm* — Aziz M. Ahsan; Ahsan & Associates, PLLC

(57) ABSTRACT

The present invention relates generally to a container or a carton having a plurality of selectable volumes. The present invention is also directed to a container having a plurality of identified markings to reduce container volume upon partial consumption of content. The container includes a plurality of fold facilitating creases adapted to allow panels to be folded or removed along a fold facilitating crease and/or perforation. At least one set of perforations or identified creases are provided in the box so as to form a shell and a second or a secondary box, where the shell is removed after the contents of the box have been partially consumed and space becomes available. The container may further include perforations, flaps, tabs, slits, indentations, notches, along or at an edge of the panel. A blank of bendable and creaseable material for forming a predefined selectable volume carton box is also disclosed.

20 Claims, 2 Drawing Sheets

CONTAINER HAVING A PLURALITY OF IDENTIFIED MARKINGS TO REDUCE CONTAINER VOLUME DURING USE

FIELD OF THE INVENTION

The present invention relates generally to a container or a carton having a plurality of selectable volumes. The present invention is also directed to a container having a plurality of identified markings to reduce container volume upon partial consumption of content. The container includes a plurality of fold facilitating creases adapted to allow panels to be folded or removed along a fold facilitating crease and/or perforation. At least one set of perforations or identified creases are provided in the box so as to form a shell and a second or a secondary box, where the shell is removed after the contents of the box have been partially consumed and space becomes available. The container may further include perforations, flaps, tabs, slits, indentations, notches, along or at an edge of the panel. A blank of bendable and creaseable material for forming a predefined selectable volume carton box is also disclosed.

BACKGROUND INFORMATION

Various efforts have been done in the past to improve the basic design and utility of a container. Similarly, efforts have been made to further the art of container but they have had limited success.

U.S. Pat. No. 2,056,032 (Abraham Berman), the entire disclosure of which is incorporated herein by reference, discloses a variable volume box in which the outer wall is perforated at various heights, so as to be cut there along reducing the size of the box, wherein the upper outer walls of the box may be used as the flaps to close the box.

U.S. Pat. No. 3,128,031 (Gerald Dembo), the entire disclosure of which is incorporated herein by reference, discloses an invention relating to cartons, and more particularly to cartons which may be reduced in size as the contents thereof are used.

U.S. Pat. No. 3,168,234 (Fred H. Bartz), the entire disclosure of which is incorporated herein by reference, discloses form containers of the type allowing reduction of the original volume of the container by the disposal of a used section of the container after dispensing a portion of the contents of the container, while at the same time enabling closing of the reduced carton to minimize air spaces therewithin.

U.S. Pat. No. 3,291,372 (William R. Saidel), the entire disclosure of which is incorporated herein by reference, discloses a laminated and reclosable carton box having strips located on the outer surface thereof at various levels so as to reduce the carton in height when those strips are removed. A top box may be placed at the various levels once the levels are reduced.

U.S. Pat. No. 3,302,855 (William C. Becker), the entire disclosure of which is incorporated herein by reference, discloses an improved container construction wherein the same can be reduced in size as the product thereof is progressively removed so that the container construction of this invention will only require a minimum of storage space for the amount of product still remaining in the container construction.

U.S. Pat. No. 3,971,506 (Robert Fred Roenna) the entire disclosure of which is incorporated herein by reference, discloses a tear open and relockable cardboard container comprising a first and a second top member having a first and a second top fold and a first and a second top edge which top members are secured in an overlapping relationship to form a top of the container. The first top member has a container aperture perforation with a locking projection extending toward the first edge. Locking slots extend from the sides of the container aperture perforation. The second member has a first and a second perforation with a lift tab fold line extending between the first and second perforation defining a lift tab therebetween. A lift tab perforation is located on the second top member and intersects the lift tab fold line forming a reopen tab. The container is opened by raising the lift tab to expose the container aperture. The container is relocked by inserting the lift tab into the locking slots with the locking projection extending through the lift tab perforation resulting in a first engagement between the lift tab and the bottom surface of the first member and resulting in a second engagement between the reopen tab and the top surface of the first member. The lift tab forms an obtuse angle with the second member resulting in an increase in the force of the first and second engagements by the weight of the contents of the container upon the lift tab when the container is overturned. The foregoing abstract is merely a resume of one general application, is not a complete discussion of all principles of operation or applications, and is not to be construed as a limitation on the scope of the claimed subject matter.

U.S. Pat. No. 4,512,478 (Ralph J. Korte), the entire disclosure of which is incorporated herein by reference, discloses a paperboard container having an opening member defined by an array of perforations. A coating of plastically deformable and readily rupturable material is disposed on the inside surface of the container and extends on each side of each perforation in the array of perforations including the continuous section of paperboard material between adjacent perforations. The cooperation of the coating of plastically deformable material and the paperboard material ensures that the severances between adjacent perforations will be more precise, less ragged and will not produce detached slivers of paperboard material.

U.S. Pat. No. 4,648,513 (William R. Newman), the entire disclosure of which is incorporated herein by reference, discloses an invention that is generally accomplished by providing a sheet of cover material, folding the sheet such that one portion to become the front extends up to a line slightly below the edge of the portion to become the back. The flap of the back portion extending above the front is coated with adhesive; the disposal container is formed by sealing the sides of the folded sheet. Outward of the seal lines that form the container are placed tear lines such as perforation lines. The object to be wrapped then is placed onto the exterior side of the front of the container, and the container is wrapped around the object and sealed with the adhesive strip on the flap to form a package. The ends of the package are then sealed. The package may be opened by tearing at the perforations and unrolling the container by releasing the adhesive flap to recover the wrapped article. After use the used article may be placed inside the container which is then sealed with the pressure-sensitive adhesive on the flap by adhering the flap to the front of the container. In a particularly preferred form, the package is used for wrapping and disposal of catamenial devices. The packages may be made from continuous strips of polymer sheet that are heat sealed at the end of each package and then cut between the packages.

U.S. Pat. No. 5,251,808 (Darryl J. Rudd), the entire disclosure of which is incorporated herein by reference, discloses a variable volume carton box having a top lid with flaps which are secured in the conventional manner for cereal boxes or other boxes used to contain like commodities sold in grocery stores and supermarkets. At least one intermediate circumferential perforation is located around the box so as to allow the box to be reduced in size. Once the box is reduced in size by tearing or cutting along the perforation, another set of intermediate flaps are attached circumferentially around an interior section of the carton box to form the new lid used when the box is reduced in size. If a flexible airtight lining is used within the box, a circumferential perforation or mark line is located thereon just above the circumferential perforation of the variable volume carton box to allow the lining to be folded, thereby forming an airtight lining within the reduced volume carton box.

U.S. Pat. No. 6,676,009 (Harold J. Rose), the entire disclosure of which is incorporated herein by reference, discloses in a container having a plurality of selectable volumes including a plurality of fold facilitating creases adapted to allow panels to be folded or removed along a fold facilitating crease and/or perforation, further including a first set and a second set of perforations or other separating mechanism extending substantially parallel to a corner edge to thereby define a removable strip for unconnecting panels that form a corner edge from one another. The first set of perforations and the second set of perforations or other separating mechanism are positioned at a spaced distance from each other. The first set of perforations or other separating mechanism is provided on a first panel while the second set of perforations or other separating mechanism is provided on either the corner edge itself or a second panel that form the corner edge. The container may further include lateral perforations as well as flaps, tabs, slits and slots along a top edge of the panels.

U.S. Pat. No. 7,988,034 (Paul Pezzoli), the entire disclosure of which is incorporated herein by reference, discloses a container that is designed for shipping and holding various items. The container is formed from a blank of a material, such as corrugated material, plastic, paperboard, etc. and includes side panels extending between a top portion and a bottom portion. A tear line extends around the side panels for disengaging the top portion from the container thereby exposing all of the items extending along the side panels. An improved configuration of the perforations or slits along the tear line prevents the corners defined between the side panels from being damaged and deformed and provides for smooth tearing of the tear line from the container. A second tear section is defined in a portion of the container by a perforation line with the tear section being separable from the top portion thereby partially exposing the items contained in the container.

None of the above inventions and patents, taken either singly or in combination, is seen to describe the instant invention as claimed.

This invention improves on the deficiencies of the prior art and provides an inventive reduceable container.

PURPOSES AND SUMMARY OF THE INVENTION

The invention is directed to a container having a plurality of identified markings to reduce container volume upon consumption of content.

Therefore, one purpose of this invention is to provide a cost effective, and a durable container having a plurality of identified markings to reduce container volume upon consumption of content.

Another purpose of this invention is to provide a container that includes a plurality of fold facilitating creases adapted to allow panels to be folded or removed along a fold facilitating crease and/or perforation.

Yet another purpose of this invention is to provide at least one set of perforations or identified creases on the outer surface of the box so as to form a shell and a second box, where the shell is removed after the contents of the box have been partially consumed and space becomes available for the formation of the intermediate or secondary box.

Still yet another purpose of this invention is to have a container that may further include perforations, flaps, tabs, slits, indentations, notches, in or along a panel.

Therefore, in one aspect this invention comprises a predefined selectable volume carton box having a front side, a back side, a right side, a left side, a top portion, and a bottom portion, said predefined selectable volume carton box comprising an upper closable lid located at the top portion thereof, and wherein said predefined selectable volume carton box further comprises:

(a) at least one intermediate box located within said predefined selectable volume carton box between said top portion and said bottom portion of said predefined selectable volume carton box;

(b) said at least one intermediate box being defined by an upper peripheral marking and a lower peripheral marking on the outside surface of said predefined selectable volume carton box;

(c) said upper peripheral marking defining at least one removeable portion of said predefined selectable volume carton box to form at least one removable sleeve; and (d) said lower peripheral marking defining a bendable portion for said at least one intermediate box.

In another aspect this invention comprises a blank of bendable and creaseable material for forming a predefined selectable volume carton box, said blank comprising:

(a) a first narrow side having a first left narrow side edge, a first right narrow side edge, a first narrow top edge, and a first narrow bottom edge;

(b) a first wide side having a first left wide side edge, a first right wide side edge, a first wide top edge, and a first wide bottom edge, and wherein said first right narrow side edge is parallel and secured to said first left wide side edge;

(c) a second narrow side having a second left narrow side edge, a second right narrow side edge, a second narrow top edge, and a second narrow bottom edge, and wherein said first right wide side edge is parallel and secured to said second left narrow side edge;

(d) a second wide side having a second left wide side edge, a second right wide side edge, a second wide top edge, and a second wide bottom edge, and wherein said second right narrow side edge is parallel and secured to said second left wide side edge;

(e) said blank comprising at least one upper peripheral marking from said first left narrow side edge to said second right wide side edge, and at least one lower peripheral marking from said first left narrow side edge to said second right wide side edge;

(f) wherein said at least one upper peripheral marking, and said at least one lower peripheral marking are on the outside surface of said predefined selectable volume carton box; and (g) wherein portion of said at least one upper peripheral, marking to said first narrow bottom edge, said first wide bottom edge, said second narrow bottom edge, said second wide bottom edge, including said at least one lower peripheral, marking define at least one intermediate box.

In yet another aspect this invention comprises predefined selectable volume carton box having a front side, a back side, a right side, a left side, a top portion, and a bottom portion, said predefined selectable volume carton box comprising an upper closable lid located at the top portion thereof, and wherein said predefined selectable volume carton box further comprises:

(a) at least one intermediate box located within said predefined selectable volume carton box between said top portion and said bottom portion of said predefined selectable volume carton box;

(b) said at least one intermediate box being defined by an upper peripheral marking and a lower peripheral marking on the outside surface of said predefined selectable volume carton box;

(c) said upper peripheral marking defining at least one removeable portion of said predefined selectable volume carton box to form at least one removable sleeve;

(d) said lower peripheral marking defining a bendable portion for said at least one intermediate box;

(e) said intermediate box has an intermediate closable lid along said bendable portion comprising a first top elongated intermediate flap with a first intermediate slot located thereon, a second top elongated intermediate flap with a first intermediate tab located thereon, and wherein said first intermediate tab and said first intermediate slot cooperate in such a manner as to securely close and open said intermediate closable lid.

BRIEF DESCRIPTION OF THE DRAWINGS

Although the scope of the present invention is much broader than any particular embodiment, a detailed description of the preferred embodiment follows together with drawings. These drawings are for illustration purposes only and are not drawn to scale. Like numbers represent like features and components in the drawings. The invention may best be understood by reference to the ensuing detailed description in conjunction with the drawings in which.

DETAILED DESCRIPTION

Sometimes it takes a while to finish a box of food or anything and storing the original box when the plastic bag inside is almost done can be space consuming. To make an efficient use of space it would be beneficial to have a box that can be torn, for example, in half. This box has perforated side edges and a peripheral perforations along the front, back, and the two sides so that it can be easily torn so the box is reduced to, for example, half its size.

Figure 1:
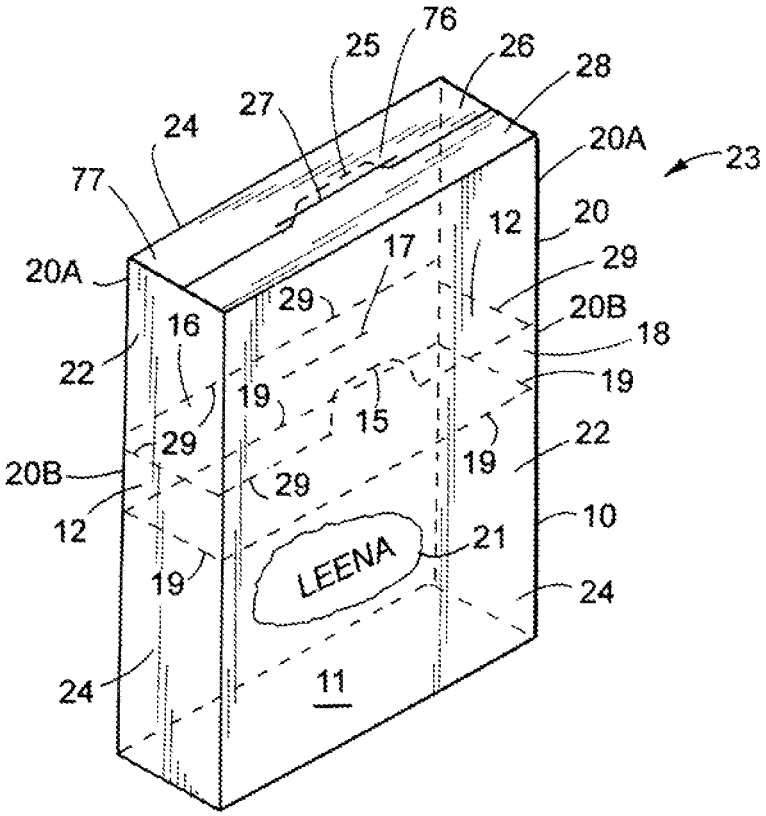
FIG. 1, illustrates a perspective view of a variable volume box according to a first embodiment of the invention.

FIG. 1, illustrates a perspective view of a variable volume box 23, according to a first embodiment of the invention. The variable volume box or container or carton 23, comprises of a base or bottom 11, a first or lower box portion 10, a second or upper box portion 20, a top portion 77, comprising a first flap or closure 26, and a second flap or closure 28. The first flap 26, could have a slit or opening or receiving area 27, to receive a portion of a tab or protrusion 25, of the second flap 28. A portion of the receiving area 27, could also have an adhesive 76, as such a resealable adhesive 76, which are well known in the art that could be used to resealably secure a portion of the tab 25, to a portion of the first flap 26, around the receiving area 27. The upper portion 20, and the lower portion 10, of the container 23, further comprise of two first or narrow face wall or sides 22, and two second or wide face wall or sides 24, such that they form a square or a rectangular or a polygonal shaped box 23. Separating the lower box portion 10, from the upper box portion 20, is at least one peripherally formed perforation or weakened area or marked area or foldable area or creaseable area 19. Above the foldable area 19, in the second or upper removable portion 20, is at least one peripherally marked perforation area 29, which can be used as a guide to separate the upper removable portion 20, from the lower box 10. Between the peripherally marked perforation area 29, and the foldable area 19, is a first or broad side flap 16, a second or broad side flap 18, and optionally at least one first narrow side flap 12. The first broad side flap 16, could have a limited perforation or slit or opening or receiving area 17, to receive a portion of a tab or protrusion 15, of the second flap 18. It should be appreciated that both the slit 17, and the tab 15, are marked or identified on the face or outside surface of the box 23, however they do not exist or appear to operate independently or become available for use until the upper removal portion 20, of the box 23, is removed along path identified by the removal portion 29. The carton 23, could have a liner or inner sleeve (not shown), which is well known in the art. Any contents (not shown) could be contained within the container 23, or within the inner liner (not shown). The inner liner (not shown) is usually made from a collapsible material, such as, polyethylene, wax paper, to name a few, which are typically made to form a plastic type bag or container. As shown in FIG. 1, the lower box portion 10, and the upper removal portion 20, are sold to a customer with the markings 15, 19, and perforations 17, 29, on the face or the outside surface of the box 23, while the contents are inside the box 23. It is only when the contents are partially consumed or when the customer wants to make space as the box 23, is taking up space while the original contents, for example, are below the foldable area 19, the customer at that time could easily press along the preformed perforations 29, and remove the upper removal portion 20. After the removal of the upper removal portion 20, the customer would then bend the two optional narrow side flap 12, towards the inside of the box 10, and also the broad or wide side flap 16, 18, towards the inside of the box 10. Once the crease or fold along the foldable path 19, has been established the customer would press at the slit area 17, to open the slit area 17, which slit or area 17, would then be used to receive the tab 15. Thus the upper removal portion 20, that did not have any content, but was taking up shelf space at a consumer location, such as, home or office, once removed, would allow for box 10, that still has the remaining contents to still provide useful service while taking substantially less shelf space. Optionally, the upper removable portion 20, could also have pre-identified markings or perforations 20A, along each edge of the upper removable portion 20, of the variable volume box 23, so that it is very easy for a user or customer to remove the upper removable portion 20, not only along the peripheral perforations 29, but also along the plurality of edges 20A. The variable volume box 23, also has pre-identified markings or perforations 20B, along each edge between the upper removable portion 20, and the foldable area 19, so that it is very easy for a user or customer to remove the upper removable portion 20, not only along the peripheral perforations 29, but also along the plurality of edges 20B, and allow the narrow side flaps 12, and the broad side flap 16, 18, to independently be bendable or foldable. For some applications the predefined selectable volume carton box 23, could also have at least one printed indicia 21. The at least one printed indicia 21, could be selected from a group comprising, product information, advertising, promotional material, slogans, to name a few.

Figure 2:
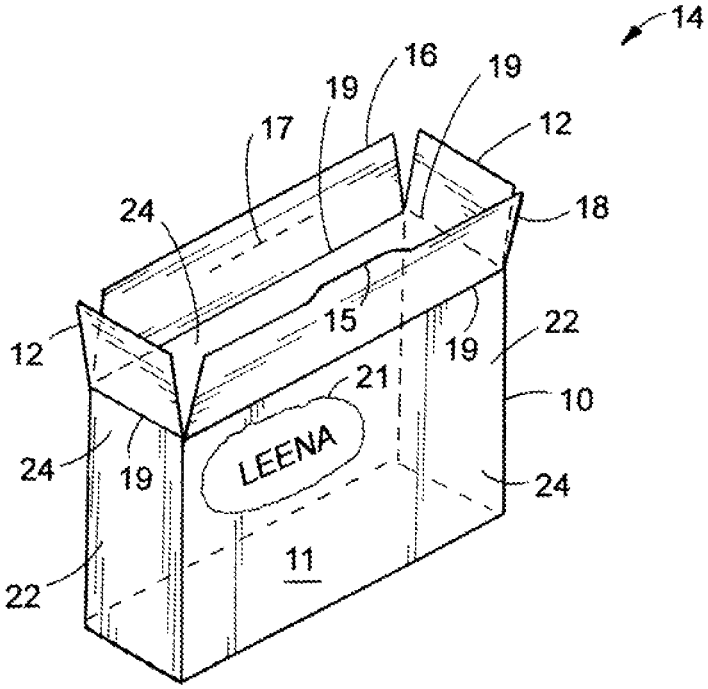
FIG. 2, illustrates a perspective view of a variable volume box according to a second embodiment of the invention.

FIG. 2, illustrates a perspective view of a variable volume box 14, according to a second embodiment of the invention. The variable volume box or container or carton 14, has been formed by the removal of the upper removal portion 20, along the path identified by the removal portion 29. The carton 14, comprises of the base or bottom 11, the first or lower or intermediate or secondary box portion 10, the two first or narrow side wall or face 22, the two second or the wide face wall or side 24, the first flap or closure 16, and the second flap or closure 18. As shown in FIG. 2, the upper removal portion 20, from FIG. 1, has been removed by the customer. The customer can now separate the two optional narrow side flap 12, from the adjacent broad side flap 16, 18, and bend them towards the inside of the box 10, along the marked or bendable or crease area 19. Similarly, the customer can now also separate the broad side flap 16, 18, from the two adjacent optional narrow side flaps 12, and bend them towards the inside of the box 10, along the indentation 19. Once the crease or fold along the foldable path 19, has been established the customer would press at the slit area 17, on the broad side flap 16, to open the slit area 17, which slit or area 17, would then be used to receive the tab 15, on the broad side flap 18. Thus, the upper removal portion 20, that did not have any content, but was taking up shelf space at a consumer location, such as, home or office, once removed, allows box 10, that still has the remaining contents to still provide useful service while taking substantially less shelf space. The at least one printed indicia 21, could be selected from a group comprising, product information, advertising, promotional material, slogans, to name a few.

Figure 3:
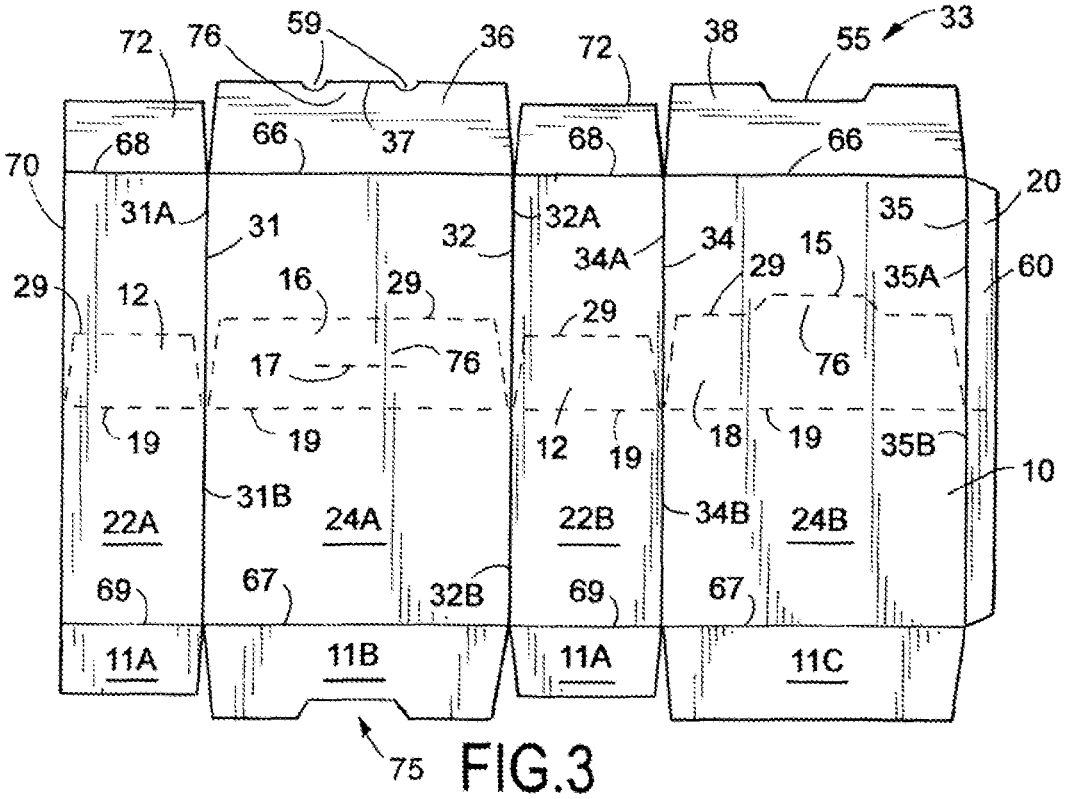
FIG. 3, illustrates a plan view looking at the outside surface of a blank structure of a carton incorporating features of the present invention according to a third embodiment of the invention.

FIG. 3, illustrates a plan view looking at the outside surface of a blank structure of a carton 33, incorporating features of the present invention according to a third embodiment of the invention. The blank carton 33, is shown in a flattened mode 33, where the blank carton 33, comprises of a first narrow side wall 22A, connected to a first wide face wall 24A, along a crease or fold 31. The first wide face wall 24A, is connected to the second narrow side wall 22B, on the opposite side along crease or fold 32. The second narrow side wall 22B, is connected to a second wide face wall 24B, along crease or fold 34. Optionally, a wide tab or lip 60, could be provided to the second wide face wall 24B, along a fold or crease 35. The wide tab 60, is normally secured to the first or narrow side wall 22A, along an edge 70, so as to form a square or rectangular or a polygonal shaped container 23, as shown in FIG. 1. An upper edge of the first narrow side wall 22A, could have an optional upper tab or flap 72, along crease or fold line 68, and an optional or lower tab or flap 11A, along crease or fold line 69. An upper edge of the second narrow side wall 22B, could have an optional upper tab or flap 72, along crease or fold line 68, and an optional or lower tab or flap 11A, along crease or fold line 69. An upper edge of the first wide face wall 24A, has an upper tab or flap 36, along crease or fold line 66, and a lower wide tab or flap 11B, along crease or fold line 67. Flap 11B, could have optional recess portion 75. An upper edge of the second wide face wall 24B, has an upper tab or flap 38, along crease or fold line 66, and a lower wide tab or flap 11C, along crease or fold line 67. FIG. 3, further illustrates that at least one peripherally formed perforation or weakened area or marked area or foldable area or creaseable area 19, that runs horizontally from one edge to another edge of the blank 33. Above the foldable area 19, in the second or upper removable portion 20, there is at least one peripherally marked perforation or marked area 29, which can be used as a guide to separate the upper removable portion 20, from the lower or intermediate box 10. It should be understood that the fold or crease lines 31, 32, 34, 35, run vertically along both the upper removal portion 20, and the lower box portion 10, along the corners or edges of the box 23, and portions of which run along the removal portion 29, are used to separate the two narrow side flap 12, and the wide side flap 16, 18. The tab or flap 36, has at least two indentations 59, so as to create a flap portion 37. The tab or flap 38, has a receiving recess portion 55, for engageably securing the flap portion 37, via indentations or notches 59, such that a portion of the tab 37, is below the recess portion 55, while a portion of the flap 36, is above the flap 38. The fold or crease lines 31, 32, 34, 35, that run vertically along both the upper removal portion 20, and the lower box portion 10, can be further subdivided into lines 31A, 32A, 34A, 35A, respectively, for the portion that is above the foldable area 19, and lines 31B, 32B, 343B, 35B, respectively, for the portion that is below the foldable area 19. Lines 31A, 32A, 34A, 35A, can have perforation markings 31A, 32A, 34A, 35A, for easy removal or separation from the variable volume box 23, illustrated in FIG. 1. It should be appreciated that vertical lines 31B, 32B, 34B, 35B, below the foldable area 19, are fold or crease lines that integrate into and form the intermediate container 14, illustrated in FIG. 2, after the separation of the upper removal portion 20, of the carton 23. The blank 33, also has the tab area 15, and slit area 17, pre-marked or scored during manufacturing.

Figure 4:
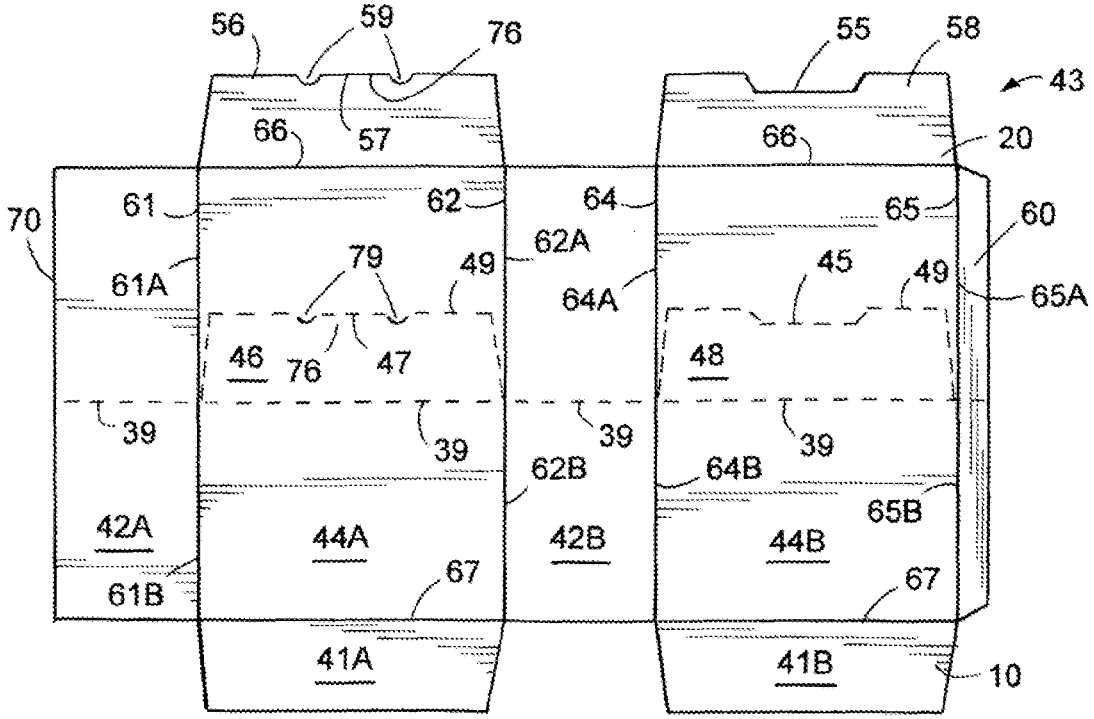
FIG. 4, illustrates a plan view looking at the outside surface of a blank structure of a carton incorporating features of the present invention according to a fourth embodiment of the invention.

FIG. 4, illustrates a plan view looking at the outside surface of a blank structure of a carton 43, incorporating features of the present invention according to a fourth embodiment of the invention. The blank carton 43, is shown in a flattened mode 43, where the blank carton 43, comprises of a first narrow side wall 42A, connected to a first wide face wall 44A, along a crease or fold 61. The first wide face wall 44A, is connected to the second narrow side wall 42B, on the opposite side along crease or fold 62. The second narrow side wall 42B, is connected to a second wide face wall 44B, along crease or fold 64. Optionally, a wide tab or lip 60, could be provided to the second wide face wall 44B, along a fold or crease 65. The wide tab 60, is normally secured to the first or narrow side wall 42A, along an edge 70, so as to form a square or rectangular or a polygonal shaped container 23, as shown in FIG. 1. An upper edge of the first wide face wall 44A, has an upper tab or flap 56, along crease or fold line 66, and a lower wide tab or flap 41A, along crease or fold line 67. An upper edge of the second wide face wall 44B, has an upper tab or flap 58, along crease or fold line 66, and a lower wide tab or flap 41B, along crease or fold line 67. FIG. 4, further illustrates the at least one peripherally formed perforation or weakened area or marked area or foldable area or creaseable area 39, that runs horizontally from one edge to another edge of the blank 43. Above the foldable area 39, in the second or upper removable portion 20, there is at least one peripherally marked perforation or marked area 49, which can be used as a guide to separate the upper removable portion 20, from the lower or intermediate or secondary box 10. It should be understood that the fold or crease lines 61, 62, 64, 65, run vertically along both the upper removal portion 20, and the lower box portion 10, along the corners or edges of the box 23, and portions of which run along the removal portion 49, are used to separate the wide side flap 46, 48, from the rest of the upper removeable portion 20. The tab or flap 56, has at least two indentations 59, so as to create a flap portion 57. The tab or flap 58, has a receiving recess portion 55, for engageably securing the flap portion 57, via indentations or notches 59, such that a portion of the tab 57, is below the recess portion 55, while a portion of the flap 56, is above the flap 58. Similarly, the carton 43, has flap portion 46, along a crease or fold line 39, that can be folded once the upper removal portion 20, has been removed. The flap portion 46, has at least two indentations or notches 79, that help create a tab portion 47. The carton 43, further has a flap portion 48, along a crease or fold line 39, that can be folded once the upper removal portion 20, has been removed. The flap portion 48, has at least one recess area or portion 45, that can be used to engage with indentations or notches 79, using the tab portion 47, to create a closeable container 10, 14, 43, once formed into a square or rectangular or polygonal shape, similar to box 23, shown in FIG. 1. The fold or crease lines 61, 62, 64, 65, that run vertically along both the upper removal portion 20, and the lower box portion 10, can be further subdivided into lines 61A, 62A, 64A, 65A, respectively, for the portion that is above the foldable area 39, and lines 61B, 62B, 64B, 65B, respectively, for the portion that is below the foldable area 39. Lines 61A, 62A, 64A, 65A can have perforation markings 61A, 62A, 64A, 65A, for easy removal or separation from the variable volume box 23, illustrated in FIG. 1. It should be appreciated that vertical lines 61B, 62B, 64B, 65B, below the foldable area 39, are fold or crease lines that integrate into and form the intermediate container 14, illustrated in FIG. 2, after the separation of the upper removal portion 20, of the carton 23. Adhesive 76, as such a resealable adhesive 76, could be applied or secured onto the carton 43, as needed.

The predefined selectable volume carton box 23, could be made from a material that is suitably strong but creasable and foldable material. The predefined selectable volume carton box 23, could be made from a material selected from a group comprising cardboard, corrugated cardboard and the like, fibrous paperboard, plastics or similar products which are creasable and foldable.

This invention allows for a user to create a selected volume for the container 23. For example, a user would select a volume that the user desires and then can remove the sleeve portion 20, so as to create a smaller or secondary or intermediate box 14, which is foldably adjustable with respect to a height dimension and consequent volume in order to accommodate articles or collections of articles having a specific volume. The variable volume container 23, also eliminates the need for carton providers to purchase and stock a great variety of sizes of boxes and containers. Storage of variable volume boxes 23, is more efficient, and consumers purchasing boxes 23, for shipping or any other purpose do not have to worry about or guess what size box 23, is appropriate for their packages or business or personal contents or food items.

It should be appreciated that the predefined selectable volume carton box 23, has the lower peripheral marking 19, defining a bendable portion for the intermediate box 14, and wherein the lower peripheral marking 19, is substantially parallel to an outer peripheral portion of the base or bottom portion 11.

For some applications the outer peripheral portion of the base or bottom portion 11, has a rectangular shape so that the predefined selectable volume carton box 23, has a rectangular shape. The outer peripheral portion of the base or bottom portion 11, could also have a polygonal shape so that the predefined selectable volume carton box 23, is polygonal in shape.

The predefined selectable volume carton box 23, could also have at least one printed indicia 21. The at least one printed indicia 21, could be selected from a group comprising, product information, advertising, slogans, to name a few.

The predefined selectable volume carton box 23, having the intermediate box 14, has an intermediate lid or cover 16, 18, comprising a top elongated intermediate flap 16, with at least one first intermediate slot 17, located thereon, and a second top elongated intermediate flap 18, with a first intermediate tab 15, located thereon, and third and fourth, top side intermediate flaps 12, located between the first and the second top elongated intermediate flaps 16, 18, wherein the first intermediate tab 15, and the first intermediate slot 17, cooperate in such a manner as to open or securely close the intermediate closable lid 16, 18.

The predefined selectable volume carton box 23, 43, wherein the intermediate box 14, has an intermediate closeable lid 46, 48, which comprises of a top elongated intermediate flap 46, having at least two indentations 79, located thereon, and a second top elongated intermediate flap 48, with an intermediate tab relief 45, located thereon, and wherein the intermediate relief tab 45, and the at least two indentations 79, cooperate in such a manner so as to securely close the intermediate closeable lid 46, 48, and forming a tuck-in closing flap 46, 48.

The predefined selectable volume carton box 23, has the upper peripheral marking 29, that define the removeable portion 20, of the predefined selectable volume carton box 23, which are located at a predetermined distance above the lower peripheral marking 19, so as to allow the predefined selectable volume carton box 23, to be reduced in size. The predetermined distance could be selected between about one quarter distance from the base or bottom portion 11, to the top portion 77, of the predefined selectable volume carton box 23, to about three quarter distance from the base or bottom portion 11, to the top portion 77, of the predefined selectable volume carton box 23. The predetermined distance could be selected from a group comprising of about one quarter distance from the bottom portion 11, to the top portion 77, of the predefined selectable volume carton box 23, or about one third distance from the base or bottom portion 11, to the top portion 77, of the predefined selectable volume carton box 23, or about one half distance from the bottom or base portion 11, to the top portion 77, of the predefined selectable volume carton box 23, or about one two third distance from the bottom portion 11, to the top portion 77, of the predefined selectable volume carton box 23, or about three quarter distance from the base or bottom portion 11, to the top portion 77, of the predefined selectable volume carton box 23.

The blank 33, 43, of a bendable and creaseable material for forming a predefined selectable volume carton box 23, has at least one upper peripheral marking 29, having perforations 29, so that at least one portion 20, can be separated from the predefined selectable volume carton box 23, 33, 43. It should be appreciated that the lower peripheral marking 19, 39, can be used as an edge to bend the flaps 12, 16, 18, 46, 48, and to define at least one intermediate box 14.

The blank 33, of a bendable and creaseable material for forming a predefined selectable volume carton box 23, can have at least one slit portion 17, that is defined in the blank 33, between the first left wide side edge 31A, the first right wide side edge 32A, the upper peripheral marking 29, and the at least one lower peripheral marking 19.

The blank 33, of a bendable and creaseable material for forming a predefined selectable volume carton box 23, can have at least one tab portion 15, that is defined in said blank 33, between the first left wide side edge 31A, the first right wide side edge 32A, the at least one upper peripheral marking 29, and the at least one lower peripheral marking 19.

It should be appreciated that the tab or flap 11B, 11C, 16, 18, 26, 28, 36, 38, 41A, 41B, 56, 58, could have a tab 15, 25, relief area 45, 55, 75, notches or indentations 59, 79, slits 17, 27, to name a few.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A predefined selectable volume carton box having a front side, a back side, a right side, a left side, a top portion, and a bottom portion, said predefined selectable volume carton box comprising an upper closable lid located at the top portion thereof, and wherein said predefined selectable volume carton box further comprises:

(a) at least one intermediate box located within said predefined selectable volume carton box between said top portion and said bottom portion of said predefined selectable volume carton box;

(b) said at least one intermediate box being defined by an upper peripheral marking and a lower peripheral marking on the outside surface of said predefined selectable volume carton box;

(c) said upper peripheral marking defining at least one removeable portion of said predefined selectable volume carton box to form at least one removable sleeve;

(d) said lower peripheral marking defining a bendable portion for said at least one intermediate box;

(e) said bendable portion of said at least one intermediate box has at least one first intermediate tab on at least one first intermediate bendable flap;

(f) said bendable portion of said at least one intermediate box has at least one first intermediate tab receiving area on at least one second intermediate bendable flap, such that upon removal of said at least one removeable portion of said predefined selectable volume carton box said at least one first intermediate tab receiving area engages with said at least one first intermediate tab so as to cooperate in such a manner as to securely close and open an intermediate closable lid of said at least one intermediate box;

(g) said bendable portion of said at least one intermediate box, said at least one first intermediate tab, and said at least one first intermediate tab receiving area are all defined on the exterior surface of said predefined selectable volume carton box; and (h) said bendable portion of said at least one intermediate box, said at least one first intermediate tab, and said at least one first intermediate tab receiving area are an integral part of said exterior surface of said predefined selectable volume carton box;

(i) said at least one first intermediate bendable flap is independent from said at least one second intermediate bendable flap; and (j) wherein said at least one first intermediate bendable flap can independently rotate about said lower peripheral marking, while said at least one second intermediate bendable flap can independently rotate about said lower peripheral marking, and wherein said rotation of said at least one first intermediate bendable flap is independent from said rotation of said at least one second intermediate bendable flap.

2. The predefined selectable volume carton box of claim 1, wherein said lower peripheral marking, defining said bendable portion for said at least one intermediate box is substantially parallel to an outer peripheral portion of said bottom portion.

3. The predefined selectable volume carton box of claim 1, wherein an outer peripheral portion of said bottom portion has a rectangular shape so that said predefined selectable volume carton box is rectangular.

4. The predefined selectable volume carton box of claim 1, wherein an outer peripheral portion of said bottom portion has a polygonal shape so that said predefined selectable volume carton box is polygonal.

5. The predefined selectable volume carton. box of claim 1, wherein at least a portion of an outer surface of said predefined selectable volume carton box has at least one printed indicia.

6. The predefined selectable volume carton box of claim 1 wherein said predefined selectable volume carton box is made from a material selected from a group consisting of cardboard, corrugated cardboard, fibrous paperboard, and plastics which are creasable and foldable.

7. The predefined selectable volume carton box of claim 1, wherein said intermediate box having said intermediate closable lid further comprises:

(a) a first top elongated intermediate flap having said at least one first intermediate tab located thereon, and wherein said at least one first intermediate bendable flap is said first top elongated intermediate flap;

(b) a second top elongated intermediate flap having said at least one first intermediate tab receiving area located thereon, and wherein said at least one second intermediate bendable flap is said second top elongated intermediate flap;

(c) third and fourth top side intermediate flaps located between said first and second top elongated intermediate flaps;

(d) wherein said at least one first intermediate tab and said at least one first intermediate tab receiving area cooperate in such a manner as to securely close said intermediate closable lid;

(e) wherein said third and fourth top side intermediate flaps are independent from said first and second top elongated intermediate flaps; and (f) wherein said third and fourth top side intermediate flaps can independently rotate about said lower peripheral marking.

8. The predefined selectable volume carton box of claim 1, wherein said intermediate box having said intermediate closeable lid further comprises:

(a) said at least one first intermediate bendable flap having at least two indentations located thereon to form said at least one first intermediate tab;

(b) said at least one second intermediate bendable flap with a first intermediate tab relief located thereon to form said at least one first intermediate tab receiving. area; and (c) wherein said first intermediate relief tab and said at least two indentations cooperate in such a manner so as to securely close said intermediate closeable lid and form a tuck-in closing flap.

9. The predefined selectable volume carton box of claim 1, wherein said upper closeable lid comprises;

(a) a first top elongated flap with a first slot located thereon;

(b) a second top elongated flap with a first tab located thereon;

(c) third and fourth top side flaps located between said first and second top elongated flaps; and (d) wherein said first tab and said first slot, cooperate in such a manner as to securely close said upper closable lid.

10. The predefined selectable volume carton box of claim 1, wherein said upper peripheral marking defining at least one removeable portion of said predefined selectable volume carton box further comprises of at least one circumferential box perforation along said upper peripheral marking defined by said at least one first intermediate tab, and said at least one first intermediate tab receiving, area.

11. The predefined selectable volume carton box of claim 1, wherein said upper peripheral marking defining at least one removeable portion of said predefined selectable volume carton box is located at a predetermined distance above said at least one lower peripheral marking so as to allow said predefined selectable volume carton box to be reduced in size.

12. The predefined selectable volume carton box of claim 1, wherein said upper peripheral marking defining at least one removeable portion of said predefined selectable volume carton box is located at a predetermined distance above said at least one lower peripheral marking so as to allow said predefined selectable volume carton box to be reduced in size, and wherein said predetermined distance is selected between about one quarter distance from said bottom portion to said top portion of said predefined selectable volume carton box to about three quarter distance from said bottom portion to said top portion of said predefined selectable volume carton box.

13. The predefined selectable volume carton box of claim 1, wherein said upper peripheral marking defining at least one removeable portion of said predefined selectable volume carton box is located at a predetermined distance above said at least one lower peripheral marking so as to allow said predefined selectable volume carton box to be reduced in size, and wherein said predetermined distance is selected from a group consisting of about one quarter distance from said bottom portion to said top portion of said predefined selectable volume carton box, about one third distance from said bottom portion to said top portion of said predefined selectable volume carton box, about one half distance from said bottom portion to said top portion of said predefined selectable volume carton box, about two third distance from said bottom portion to said top portion of said predefined selectable volume carton box, and about three quarter distance from said bottom portion to said top portion of said predefined selectable volume carton box.

14. A blank of bendable and creaseable material for forming a predefined selectable volume carton box, said blank. comprising:

(a) a first narrow side having a first left narrow side edge, a first right narrow side edge, a first narrow top edge, and a first narrow bottom edge;

(b) a first wide side having, a first left wide side edge, a first right wide side edge, a first wide top edge, and a first wide bottom edge, and wherein said first right narrow side edge is parallel and secured to said first left wide side edge;

(c) a second narrow side haying a. second left narrow side edge, a second right narrow side edge, a second narrow top edge, and a second narrow bottom edge, and wherein said first right wide side edge is parallel and secured to said second left narrow side edge;

(d) a second wide side having a second left wide side edge, a second right wide side edge, a second wide top edge, and a second wide bottom edge, and wherein said second right narrow side edge is parallel and secured to said second left wide side edge;

(e) said blank comprising at least one upper peripheral marking, from said first left narrow side edge to said second right wide side edge, and at least one lower peripheral marking, from said first left narrow side edge to said second right wide side edge;

(f) wherein said at least one upper peripheral marking, and said at least one lower peripheral marking are on the outside surface of said predefined selectable volume carton box;

(g) wherein portion of said at least one upper peripheral marking to said first narrow bottom edge, said first wide bottom edge, said second narrow bottom edge, said second wide bottom edge, including said at least one lower peripheral marking define at least one intermediate box;

(h) said blank having at least one first intermediate tab on at least one first intermediate bendable flap of said first wide side;

(i) said blank having at least one first intermediate tab receiving area on at least one second intermediate bendable flap of said second wide side, such that upon removal of at least one removeable portion of said predefined selectable volume carton box said at least one first intermediate tab receiving area engages with said at least one first intermediate tab so as to cooperate in such a manner as to securely close and open an intermediate closable lid of said at least one intermediate box;

(j) said at least one intermediate box, said at least one first intermediate tab, and said at least one first intermediate tab receiving area are all defined on the exterior surface of said blank;

(k) said at least one intermediate box, said at least one first intermediate tab, and said at least one first intermediate tab receiving area are an integral part of said exterior surface of said predefined selectable volume carton box;

(l) wherein upon removal of at least one removeable portion of said predefined selectable volume carton box said at least one first intermediate bendable flap is independent from said at least one second intermediate bendable flap; and (m) wherein said at least one first intermediate bendable flap can independently rotate about said at least one lower peripheral marking while said at least one second intermediate bendable flap can independently rotate about said at least one lower peripheral, marking, and wherein said rotation of said at least one first intermediate bendable flap is independent from said rotation of said at least one second intermediate bendable flap.

15. The blank of bendable and creaseable material for forming a predefined selectable volume carton box of claim 14, wherein at least a portion of said at least one upper peripheral marking has perforations on said exterior surface of said blank so that at least one portion can be separated from said predefined selectable volume carton box.

16. The blank of bendable and creaseable material for forming a predefined selectable volume carton box of claim 14, wherein at least a portion of said at least one upper peripheral marking, has perforations on said exterior surface of said blank. so that at least one portion can be separated from said predefined selectable volume carton box, and wherein said at least one lower peripheral marking can be bent to define at least one intermediate box.

17. The blank of bendable and creaseable material for forming a predefined selectable volume carton box of claim 14, wherein said at least one first intermediate tab receiving area is at least one slit portion which portion is defined in said blank between said first left wide side edge, said first right wide side edge, said at least one upper peripheral marking, and said at least one lower peripheral marking.

18. The blank of bendable and creaseable material for forming a predefined selectable volume carton box of claim 14, wherein said at least one first intermediate tab is defined in said blank between said first left wide side edge, said first right wide side edge, said at least one upper peripheral marking, and said at least one lower peripheral marking.

19. The blank of bendable and creaseable material for forming a predefined selectable volume carton box of claim 14, wherein an edge of said second wide side has a lip associated therewith, and wherein said lip is secured to an edge of said first narrow side so as to form a polygonal shaped container.

20. A predefined selectable volume carton box having a front side, a back side, a right side, a left side, a top portion, and a bottom portion, said predefined selectable volume carton box comprising an upper closable lid located at the top portion thereof, and wherein said predefined selectable volume carton box further comprises:

(a) at least one intermediate box located within said predefined selectable volume carton box between said top portion and said bottom portion of said predefined selectable volume carton box;

(b) said at least one intermediate box being defined by an upper peripheral marking and a lower peripheral marking on the outside surface of said predefined selectable volume carton box;

(c) said upper peripheral marking defining at least one removeable portion of said predefined selectable volume carton box to form at least one removable sleeve;

(d) said lower peripheral marking defining a bendable portion for said at least one intermediate box;

(e) said intermediate box has an intermediate closable lid along said bendable portion comprising a first top elongated intermediate flap with a first intermediate slot located thereon, a second top elongated intermediate flap with a first intermediate tab located thereon, and wherein said first intermediate tab and said first intermediate slot cooperate in such a manner as to securely close and open said intermediate closable lid;

(f) said bendable portion of said at least one intermediate box, said first top elongated intermediate flap with a first intermediate slot, and said second top elongated intermediate flap with a first intermediate tab are all defined on the exterior surface of said predefined selectable volume carton box;

(g) said bendable portion of said at least one intermediate box, said first top elongated intermediate flap with a first intermediate slot, and said second top elongated intermediate flap with a first intermediate tab are an integral part of said exterior surface of said predefined selectable volume carton box;

(h) said first top elongated intermediate flap is independent from said second top elongated intermediate flap; and (i) wherein said first top elongated intermediate flap can independently rotate about said lower peripheral marking, while said second top elongated intermediate flap can independently rotate about said lower peripheral marking, and wherein said rotation of said first top elongated intermediate flap is independent from said rotation of said second top elongated intermediate flap.

* * * * *